US011376655B2

(12) United States Patent
Håkonsen

(10) Patent No.: US 11,376,655 B2
(45) Date of Patent: Jul. 5, 2022

(54) CASTING APPARATUS AND CASTING METHOD

(71) Applicant: NORSK HYDRO ASA, Oslo (NO)

(72) Inventor: Arild Håkonsen, Sunndalsøra (NO)

(73) Assignee: NORSK HYDRO ASA, Oslo (NO)

( * ) Notice: Subject to any disclaimer, the term of this patent is extended or adjusted under 35 U.S.C. 154(b) by 0 days.

(21) Appl. No.: 16/767,740

(22) PCT Filed: Nov. 12, 2018

(86) PCT No.: PCT/EP2018/080941
§ 371 (c)(1),
(2) Date: May 28, 2020

(87) PCT Pub. No.: WO2019/110250
PCT Pub. Date: Jun. 13, 2019

(65) Prior Publication Data

US 2021/0001394 A1 Jan. 7, 2021

(30) Foreign Application Priority Data

Dec. 4, 2017 (NO) ..... 20171932

(51) Int. Cl.
*B22D 11/103* (2006.01)
*B22D 11/049* (2006.01)

(52) U.S. Cl.
CPC ..... *B22D 11/103* (2013.01); *B22D 11/049* (2013.01)

(58) Field of Classification Search
CPC ..... B22D 41/14; B22D 41/50; B22D 11/049; B22D 11/103; B22D 11/187
See application file for complete search history.

(56) References Cited

U.S. PATENT DOCUMENTS 3,463,365 A * 8/1969 Dumont-Fillon ..... G01N 15/12 222/597
4,567,936 A * 2/1986 Binczewski ..... B22D 11/007 164/453

(Continued)

FOREIGN PATENT DOCUMENTS

JP 62107846 A * 5/1987 ..... B22D 41/50
WO WO-9636449 A1 * 11/1996 ..... B22D 11/165
WO WO-2010015230 A1 * 2/2010 ..... B22D 41/60

OTHER PUBLICATIONS

International Search Report dated Feb. 11, 2019 in International (PCT) Application No. PCT/EP2018/080941.

*Primary Examiner* — Kevin E Yoon
(74) *Attorney, Agent, or Firm* — Wenderoth, Lind & Ponack, L.L.P.

(57) ABSTRACT

A casting apparatus for continuous or semi-continuous casting having a reservoir for supplying liquid metal, a direct chill casting mold having a mold cavity for at least temporarily holding liquid metal and to at least partially solidify the liquid metal into a cast product, and a pump disposed on the flow path between the reservoir and the mold cavity, wherein the pump is operable to generate a force in the liquid metal that is acting against the tendency of the liquid metal to flow along the flow path from the reservoir into the mold cavity by gravity to control a flow of the liquid metal from the reservoir into the mold cavity, wherein the pump is a direct current electromagnetic pump.

12 Claims, 6 Drawing Sheets

(56) References Cited

U.S. PATENT DOCUMENTS

| | | | | |
|---|---|---|---|---|
| 6,321,766 | B1 * | 11/2001 | Nathenson | B22D 11/10 137/13 |
| 8,717,222 | B2 * | 5/2014 | Van Den Berg | G01S 13/88 342/22 |
| 2010/0032455 | A1 | 2/2010 | Cooper et al. | |
| 2015/0336170 | A1 * | 11/2015 | Wagstaff | B22D 37/00 420/528 |

* cited by examiner

Technical Background

CASTING APPARATUS AND CASTING METHOD

TECHNICAL FIELD

The present invention relates to a casting apparatus for continuous or semi-continuous casting of metals using a pump to counter a metal flow induced by a gravitational force to control a flow of liquid metal more precisely and with less turbulence.

BACKGROUND

In continuous or semi-continuous casting, liquid metal is supplied into a mold cavity of a casting mold. In the mold cavity, the liquid metal at least partially solidifies into a cast product that exits the mold cavity via an open side of the mold cavity caused by a relative movement between the cast product and the mold. Semi-continuous casting is for example used to cast rolling ingots (ingots that are for example hot and cold rolled to produce rolled products such as sheet metal), forging ingots (ingots that are forged into forged products) or extrusion billets (billets that are for example extruded in an extrusion press to produce an extruded product). Continuous casting is for example used to continuously produce a rolled product without producing a rolling ingot that is hot rolled and cold rolled in separate production steps as an intermediate product.

A casting apparatus usually comprises a reservoir for holding and/or producing liquid metal such as a melting furnace or a melt tank for holding liquid metal that has been supplied to the melt tank from for example a melting furnace or an electrolysis process.

From the reservoir, the liquid metal is supplied into a mold cavity of the casting mold via a flow path that is for example implemented as a distribution launder. In the mold cavity, the liquid metal cools and at least partially solidifies. The cast product exits the mold cavity via an open side thereof caused by a relative movement between the mold and the cast product as mentioned above, for example by movement of a starter block.

A conventional casting apparatus is shown in FIG. 1 and described in United States patent application US20100032455A1. As is apparent form FIG. 1, in the conventional casting apparatus, liquid metal is supplied from a reservoir via a flow path 1 (here shown in a sectional view and implemented as a launder) into the mold cavity 2 of a mold 3. The flow path 1 comprises an outlet, here implemented as a nozzle, 4 through which the liquid metal exits the flow path 1 and flows into the mold cavity 2. The driving force for the flow of the liquid metal is gravity. To control the flow of the liquid metal, there is provided a pin assembly 5, that can increase or decrease the effective cross-sectional area available for the liquid metal to flow through the nozzle 4 by a vertical movement of the pin assembly to thereby control the volumetric flow rate of the liquid metal from the flow path 1 into the mold cavity 2. The cast product exits the mold cavity 2 via a downwards movement of a starter block 6.

It is desirable to have a casting apparatus and a casting method that have a less turbulent liquid metal feeding system and allow production of cast products with improved properties such as improved surface quality.

Short Description of the Invention

The inventor has found that the quality of a cast product (also known as casted product) strongly depends on a precise control of the level of liquid metal in the mold cavity so the level of liquid metal in the mold cavity corresponds to a predetermined value despite the relative movement between the mold and the cast product during the continuous or semi-continuous casting operation. The inventor has found that a low metallostatic pressure (see p in FIG. 2) in the mold cavity and a laminar flow of the liquid metal when the liquid metal enters the mold cavity improve the quality, in particular the surface quality, of the cast product. In the conventional apparatus describe above, a precise control of the metal level in the mold cavity is difficult due to the movement of the pin assembly. Further, the conventional casting apparatus generates a turbulent flow of the liquid metal, because the effective flow cross section is reduced and a flow velocity increases according to the Venturi effect. The turbulent flow may result in oxidation of the liquid metal to be cast and quality problems of the cast product In this respect, in order to avoid or alleviate the aforementioned problems, an aspect of the present invention provides a casting apparatus for continuous or semi-continuous casting (e.g. vertical direct chill casting) of a cast product comprising a reservoir for supplying liquid metal, a direct chill casting mold having a mold cavity for at least temporarily holding liquid metal and to at least partially solidify the liquid metal into a cast product, wherein a flow path for the liquid metal is defined between the reservoir and the mold cavity, and wherein the casting apparatus is configured such that the liquid metal has a tendency to flow along the flow path from the reservoir into the mold cavity by gravity, wherein the liquid metal enters the mold cavity via a first vertically higher side of the mold, and wherein the cast product exits the mold via a second vertically lower side of the mold, and a pump disposed on the flow path between the reservoir and the mold cavity, wherein the pump is operable to generate a force in the liquid metal that is acting against the tendency of the liquid metal to flow along the flow path from the reservoir into the mold cavity by gravity to control a flow of the liquid metal from the reservoir into the mold cavity. The cast product may exit the mold in a rectilinear manner via the second side of the mold in a straight vertical direction. A longitudinal axis of the cast product may be continuously rectilinear from the at least partial solidification until the full solidification. The cast product may be an extrusion ingot or a rolling slab.

According to the invention, a larger cross-sectional area for the flow of liquid metal along the flow path can be provided than in the conventional casting apparatus while a controllability of the flow of the liquid metal is improved. The larger cross-sectional area may result in a less turbulent and more laminar flow of the liquid metal. For example, a minimum flow cross-sectional area at an outlet of the flow path according to the invention may be 2000 $mm^2$ (square millimeter), which is significantly larger than in the conventional casting apparatus using a pin assembly to control the flow of the molten metal. According to the invention, the flow of the liquid metal from the reservoir into the mold cavity is driven by gravity and the pump is used to limit the flow by generating a force acting in a direction opposite to the flow direction without changing the flow direction. In other words, according to the invention, the pump may be used as a flow regulator. According to the invention, the pump may be used to completely stop the flow of liquid metal from the reservoir into the mold cavity.

According to embodiments of the invention, the casting apparatus may further comprise a sensor for detecting a level of liquid metal in the mold cavity and for outputting a level value indicative of the level of liquid metal in the mold cavity, and a controller, wherein the sensor and the pump may be operably connected with the controller, and wherein the controller may be configured to operate the pump based on the level value and a predetermined set value indicative of a desired level of the liquid metal in the mold cavity such that a difference between the level value and the set value is minimized.

According to embodiments of the invention, the first side of the mold may be sealed and a gas atmosphere between the liquid metal in the mold cavity and the first side may be controlled such as to control oxidation of the liquid metal in the mold cavity.

According to embodiments of the invention, the sensor may be a radar sensor that emits electro-magnetic radar radiation having for example a frequency of 80 GHz or higher that may be incident on the liquid metal in the mold cavity in a radar radiation area. According to embodiments, the sensor may be a laser distance sensor, a capacitive distance sensor or an ultrasonic distance sensor. Particularly good results may be achieved with the radar sensor having a radar frequency of 80 GHz or higher, as the electromagnetic radar radiation having such a radar frequency may penetrate through smoke and dirt that may be present in the mold cavity between the sensor and the surface of the liquid metal.

According to embodiments of the invention, there may be provided an at least partially radar radiation transparent body in a radar beam path between the radar sensor and the liquid metal in the mold cavity, wherein the at least partially radar radiation transparent body may have two outer surfaces that each may have a normal vector that is not parallel to a straight line between the sensor and the liquid metal in the mold cavity in the radar radiation area to avoid or reduce detection of radar radiation reflected by the at least partially radar radiation transparent body with the radar sensor.

According to embodiments of the invention, the at least partially radar radiation transparent body may be provided integrally with the closed first side of the mold.

According to the invention, the pump is an electromagnetic pump, in particular a direct current electromagnetic pump. An electromagnetic pump is particularly efficient as it allows a precise and delay-free control of the flow of the liquid metal due to the lack of moving mechanical parts.

According to embodiments of the invention, the controller may be configured to change the predetermined set value during a casting operation of the cast product.

According to embodiments of the invention, the controller may be configured to change the predetermined set value from a value indicative of a higher level of the liquid metal in the mold cavity earlier in the casting operation of the cast product to a value indicative of a lower level of the liquid metal in the mold cavity later in the casting operation of the same cast product.

According to embodiments of the invention, the mold may comprise means for active cooling of the cast product such as a cooling water nozzle for spraying water on the cast product that is exiting the direct chill casting mold cavity via the second side.

According to the invention, the liquid metal isliquid aluminium or aluminium alloy and the cast product is an aluminium or aluminium alloy product.

According to the invention, a flow diverter is provided on the flow path downstream of the pump to direct at least a portion of the liquid metal in a predetermined direction in the mold cavity. The flow diverter may be configured such that the portion of the liquid metal is directed into a direction that is not the vertical direction. For example, the flow diverter may comprise a tubular structure having a cross-section (through which the liquid metal may flow into the mold cavity) defining a flow path for the liquid metal that has a longitudinal central axis that has a direction that deviates from the vertical direction. Said cross-section may change, e.g. continuously change, along the flow path in an upstream-downstream direction from a rectangular, e.g. quadratic, cross-section towards a rectangular cross-section neighboring the outlet of the flow diverter. This is particularly useful if the cast product is a rolling slab. The cross-section may change, e.g. continuously change, along the flow path in an upstream-downstream direction from a rectangular, e.g. quadratic, cross-section to a circular cross-section neighboring the outlet of the flow diverter. This is particularly useful if the cast product is an extrusion billet. The flow diverter may be configured such that at least a portion of the liquid metal is directed into a direction that has a horizontal component.

According to a further aspect of the invention, there is provided a method for continuous or semi-continuous casting of a cast product using the apparatus described above, the method comprising supplying liquid metal from a reservoir into a mold cavity of a direct chill casting mold along a flow path defined between the reservoir and the mold cavity by using, for example exclusively, a gravitational force, and generating a force acting on the liquid metal using a pump that acts against the flow of the liquid metal along the flow path caused by the gravitational force to control supply of the liquid metal into the mold cavity to thereby control a level of liquid metal in the mold cavity.

According to embodiments of the invention, the method may further comprise calculating a set value indicative of a desired level of the liquid metal in the mold cavity, measuring an actual value indicative of the actual level of liquid metal in the mold cavity, and controlling generating the force using the pump such that a difference between the set value and the actual value is minimized during a casting operation.

According to embodiments of the invention, generating the force using a pump may comprise generating an electromagnetic field acting on the liquid metal that results in a force having a direction opposing a flow of the liquid metal along the flow path.

All embodiments and features of the invention may be combined with each other. Features relating the apparatus also relate to the method and vice versa.

SHORT DESCRIPTION OF THE FIGURES

It should be understood that the appended drawings are not necessarily to scale, presenting a somewhat simplified representation of various features illustrative of the invention.

DETAILED DESCRIPTION

Reference will now be made in detail to various embodiments of the present invention, examples of which are illustrated in the accompanying drawings and described below. While the invention will be described in conjunction with exemplary embodiments, it will be understood that the present description is not intended to limit the invention to those exemplary embodiments.

Figure 1:
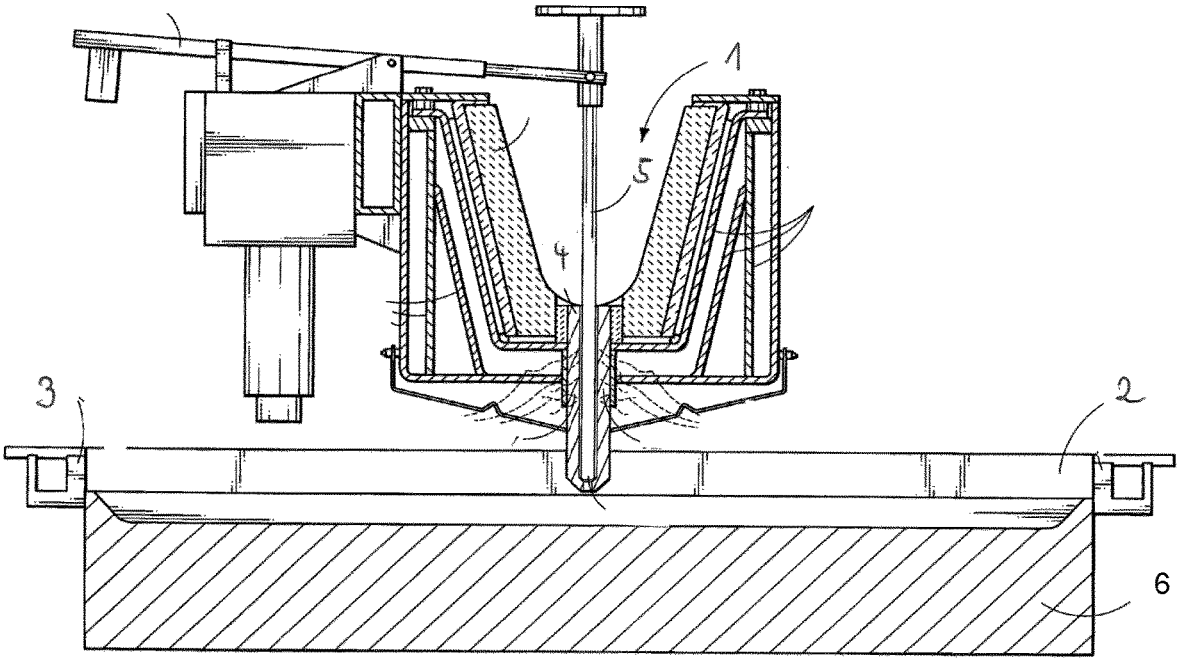
FIG. 1 shows a view of a casting apparatus according to conventional technology.
Figure 2:
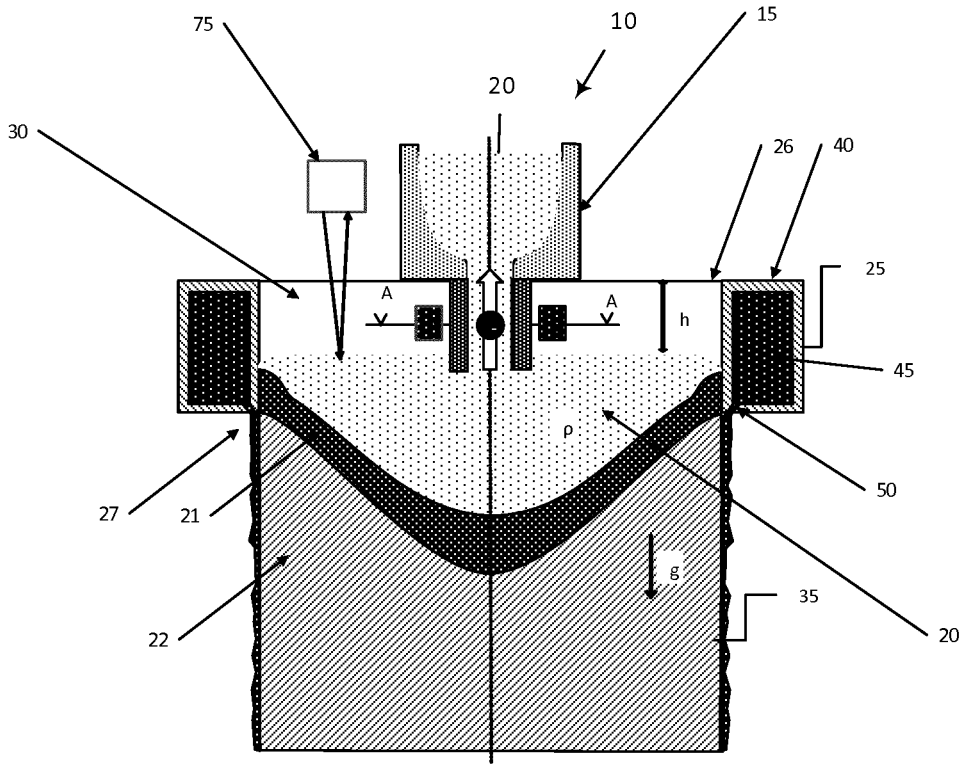
FIG. 2 shows a schematic view of a casting apparatus according to an embodiment of the invention.

With reference to FIG. 2, a casting apparatus 10 according to the invention comprises a reservoir 15. The reservoir 15 may supply liquid metal 20. For example, the reservoir may be a melting furnace or a distribution lauder or any other means for storing and/or producing liquid metal 20.

The liquid metal 20 may be liquid aluminium, liquid aluminium alloy, liquid steel or any other liquid metal.

The casting apparatus 10 further comprises a direct-chill casting mold 25. The casting mold 25 comprises a mold cavity 30 for receiving the liquid metal 20, for at least temporarily holding the liquid metal 20 and to at least partially solidify the liquid metal 20 into a cast product 35. The mold cavity 30 may be surrounded on the lateral sides thereof by a mold frame 40 of the casting mold 25. The cast product 35 may for example be a rolling ingot, an extrusion billet, a T-bar, or any other cast product 35.

The casting mold 25 may have a first, vertically higher side 26 and a second, vertically lower side 27. The liquid metal 20 may enter the mold cavity 30 via/through the first side 26. The liquid metal 20 may at least partially solidify in the mold cavity 30 to produce the cast product 35. FIG. 2 schematically shows liquid metal 20, a zone of partially solidified metal 21 in which the solidification takes place, and solidified metal 22 in the mold cavity. The cast product 35 may exit the mold cavity 30 via the second side 27 via a relative movement between the cast product 35 and the casting mold 25. The casting process of a cast product 35 may take place in a steady-state process in which—optionally after an non-steady-state initialization process—the spatial location of the zones corresponding to liquid metal 20, partially solidified metal 21 and solidified metal 22 remain stationary while the cast product 35 is produced and continually moved in a downwards direction while new liquid metal 20 is supplied into the mold cavity 30 from the reservoir 15

The casting mold 25 may comprise means for active cooling of the liquid metal 20 in the mold cavity 30 and/or for active cooling the partially solidified metal 21 and/or for active cooling of the cast product 35. In FIG. 2, the means for active cooling are implemented by a hollow water channel 45 in the mold frame 40. The means for active cooling in FIG. 2 further comprise an aperture 50 provided in the mold frame 40 such that water may exit the hollow water channel 45 via the aperture 50 and come into contact with the cast product 35 such as to cool the cast product 35. For cooling, water may be supplied into the hollow water channel 45, may cool the liquid metal 20 in the mold cavity 30 via heat transfer through the mold frame 40 and may also exit the hollow water channel 45 via the aperture 50 to directly cool the cast product 35. In FIG. 2, the water that is directly cooling the cast product 35 is schematically shown by the wavy area on the lateral sides of the cast product 35.

Figure 3:
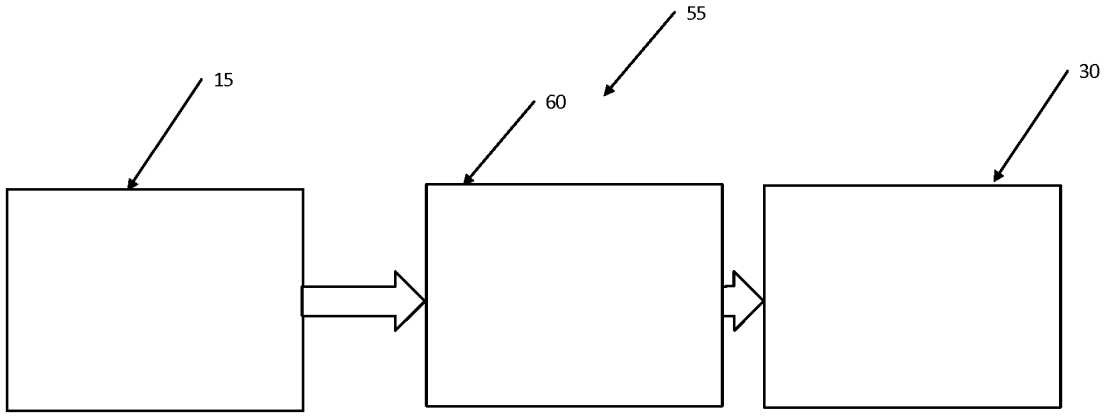
FIG. 3 shows a schematic view of a flow path according to an embodiment of the invention.

With further reference to FIG. 3, the casting apparatus 10 may comprise a flow path 55 that is defined between the reservoir 15 and the mold cavity 30. The flow path 55 may be configured such as to define a fluid connection between the reservoir 15 and the mold cavity 30 so that the liquid metal 20 can flow from the reservoir 15 into the mold cavity 30. The casting apparatus 10 may be configured such the liquid metal 20 has a tendency to flow from the reservoir 15 into the mold cavity 30. The tendency may be caused by gravity as shown by the arrow labeled g in FIG. 2 that symbolizes a vector representing gravity. The flow path 55 may be implemented as flow conduit or flow pipes or flow channel.

With reference to FIGS. 2 and 3, the casting apparatus 10 according to the invention comprises a pump 60 disposed on the flow path 55 between the reservoir 15 and the mold cavity 30. The pump 60 may be operated to produce a force acting on the liquid metal 20 that at least partially (and as a maximum fully) counters the tendency of the liquid metal 20 to flow from the reservoir 15 into the mold cavity 30. Accordingly, the flow rate of the liquid metal 20 from the reservoir 15 into the mold cavity 30 may be controlled (e.g. by limiting the flow induced by gravity) by the pump 60. The pump 60 may be operated or configured such that the maximum force generated by the pump 60 substantially stops the flow of the liquid metal 20 from the reservoir 15 into the mold cavity 30 but does not reverse the flow direction. The force generated by the pump 60 is schematically indicated by the arrow pointing upwards in FIGS. 2 and 5 to 8. By operation of the pump 60, a level h of the liquid metal 20 in the molt cavity 30 may be controlled. The inventor has found that the quality of a cast product 35 is strongly dependent on a precise control of the metal level h during the casting operation. The arrow between the pump 60 and the mold cavity 30 that is shorter than the arrow between the reservoir 15 and the pump 60 in FIG. 3 schematically indicates the control, implemented by a reduction of the flow rate induced by gravity, of the liquid metal 20 from the reservoir 15 into the mold cavity 30.

Figure 4:
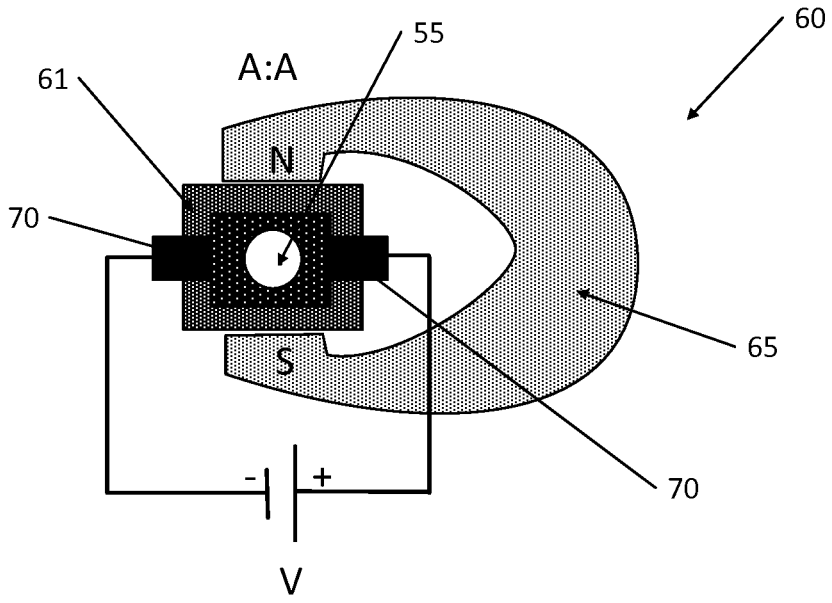
FIG. 4 shows a schematic sectional view along line A-A in FIG. 2 of a direct current electromagnetic pump according to an embodiment of the invention.

The pump 60 may for example be an electromagnetic pump, in particular a direct current (DC) electromagnetic pump of the induction type without moving parts as schematically shown e.g. in FIGS. 2 and 4. Such a pump is herein also referred to simply as DC electromagnetic pump in the following. A DC electromagnetic pump 60 is particularly advantageous in the casting apparatus 10 according to the invention as it allows a very precise control of the flow of the liquid metal 20 due to a high responsiveness (that is, a short time delay between an input signal to the pump 60 and a resulting force acting on the liquid metal 20 generated by the pump 60) and good controllability (the amount of force generated by the pump 60 can be precisely controlled via a control of the electric current supplied to the pump 60). FIG. 4 shows a schematic sectional view of a DC electromagnetic pump 60 along line A-A in FIG. 2. With reference to FIG. 4, a DC electromagnetic pump 60 may comprise a casing 61 defining a lumen that forms a section of the flow path 55. The DC electromagnetic pump 60 may further comprise a permanent magnet 65 with magnetic north pole N and magnetic south pole S arranged at opposite lateral sides of the flow path 55. The electromagnetic pump 60 may further comprise two electrodes 70 that are arranged on lateral sides of the flow path 55 such that the two electrodes 70 are arranged perpendicular to a line between the north pole N and the south pole S of the permanent magnet 65. Operating the electrodes 70 by applying electric voltage to them that will initiate an electric current through the liquid metal 20 inside the casing 61 along the flow path 55 from the reservoir 15 into the mold cavity 30 that generates a Lorentz force in the liquid metal 20, wherein the Lorentz force counters the tendency of the liquid metal 20 to flow from the reservoir 15 into the mold cavity 30 by gravity. This results in a controllable reduction or increase (by reducing a force generated by the pump 60) of the flow rate from the reservoir 10 into the mold cavity 30 allowing in turn dynamic control of the level h of liquid metal 20 in the mold cavity 30 during a casting operation.

Figure 5:
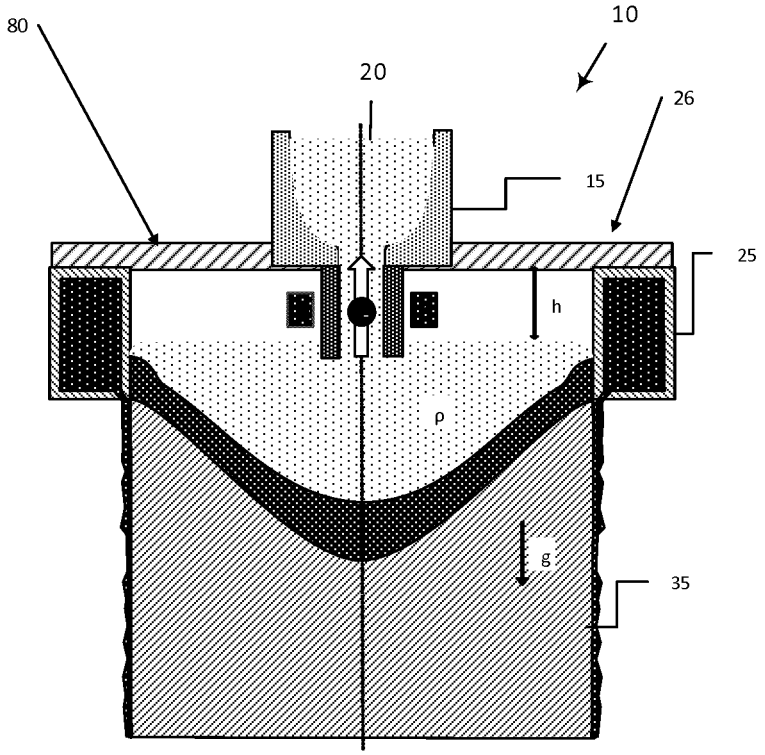
FIG. 5 shows a schematic view of a casting apparatus according to a further embodiment of the invention.

According to embodiments of the invention and with reference to FIG. 5, the first, vertically higher side 26 of the mold 25 may be provided at least partially, e.g. fully, gas-tight such as to separate the atmosphere in the mold-cavity 30 from the atmosphere surrounding the casting apparatus 10. For example, there may be provided a casing or a removable lid (in FIG. 5 exemplarily referenced with reference sign 80) in order to at least partially, e.g. fully, close the first side 26 of the mold 25 such as to separate the atmosphere inside the mold cavity 30 from the atmosphere surrounding the casting apparatus 10. The atmosphere surrounding the casting apparatus 10 may for example be ambient air in a cast house. The casting apparatus 10 may further comprise means to control the atmosphere inside the mold cavity 30, for example to control oxidation of the liquid metal 20 in the mold cavity. The means to control the atmosphere inside the mold cavity 30 may for example be implemented by a gas injection system to create an inert or reducing gas atmosphere inside the mold cavity 30.

Figure 6:
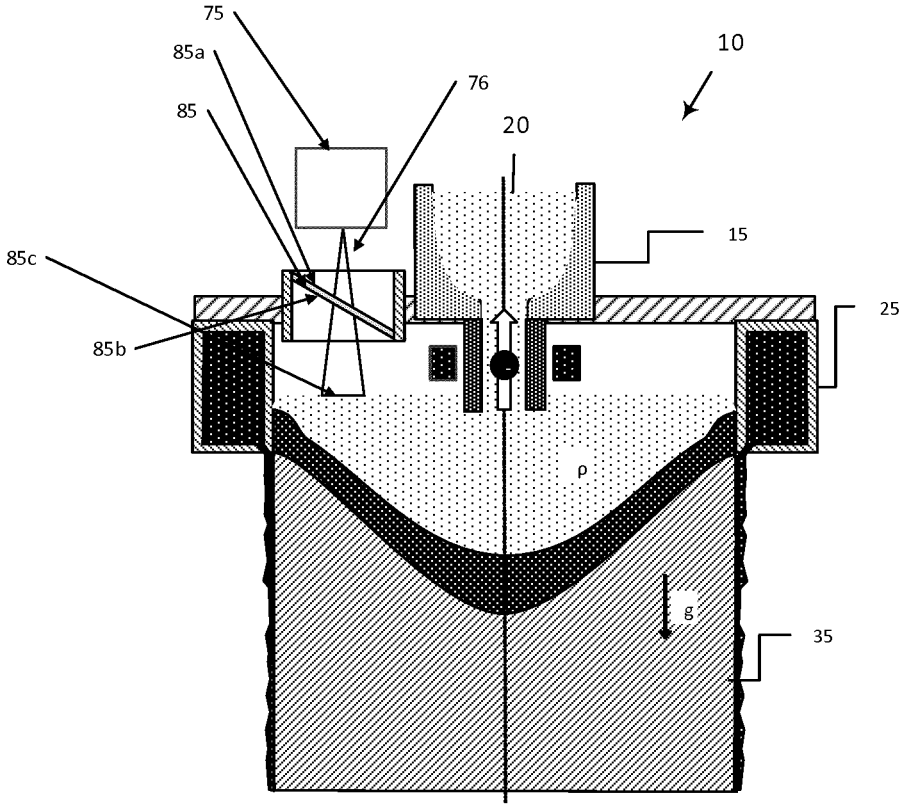
FIG. 6 shows a schematic view of a casting apparatus according to a further embodiment of the invention.

With reference to FIG. 6, the casting apparatus 10 may further comprise a sensor 75 for detecting the level h of liquid metal in the mold cavity 30 and for outputting a level value indicative of the level h of liquid metal 20 in the mold cavity 30. The sensor 75 may for example be a laser distance sensor, a capacitive distance sensor or a radar distance sensor. For example, the sensor 75 may be a radar sensor that emits electromagnetic radar radiation with a frequency of 80 Ghz or higher. The electromagnetic radiation 76 that is emitted from the sensor 75 may be incident on the liquid metal 20 in the mold cavity 30, may be reflected by the surface of the liquid metal 20, and the reflected radar radiation may be detected by a detector in the sensor 75. In FIG. 6 only the radiation 76 emitted from the sensor 75 is shown and referenced with reference sign 76 for better clarity. The level h of the liquid metal 20 in the mold cavity 30 may then be calculated via a time or phase difference between the emitted and the received electromagnetic radar radiation 76. A sensor 75 using radar radiation with a frequency of 80 GHz or more has been found to be particularly efficient, as radar radiation 76 with such a frequency can penetrate through smoke and solid deposits and thereby allow a more precise measurement of the metal level h in the mold cavity 30.

The sensor 75 (not shown in FIG. 5) may be provided inside the mold cavity 30 and at least partially vertically below the lid or casing 80. The sensor 75 may also be provided vertically above the lid or casing 80 and may emit and receive a signal to measure the level h of the liquid metal 20 via an aperture (e.g. an aperture that is transparent for a sensor signal but non-permeable for gas) in the lid or casing 80.

According to embodiments of the invention, in particular when the sensor 75 is implemented as a radar sensor (for example one with a radar frequency of 80 GHz or higher), and with reference to FIG. 6, the casing or removable lid 80 may comprise an at least partially radar radiation transparent body 85, e.g. a partially radar radiation transparent body, in a radar beam path between the radar sensor 75 and the liquid metal 20 in the mold cavity 30. The at least partially radar radiation transparent body 85 may have two (outer) surfaces 85*a*, 85*b* that each have a normal vector that is not parallel to a straight line between the sensor and the liquid metal 20 in the mold cavity 30 in the radar radiation area 85*c* to avoid detection of radar radiation reflected by the at least partially radar radiation transparent body 85 with the radar sensor 75. The radar radiation area 85*c* is the area on the surface of the liquid metal 20 in the mold cavity 30 that is exposed to radar radiation form the radar sensor 75. By using a configuration as described above and shown in FIG. 6, the detection precision can be improved as the radar sensor 75 does not detect radar radiation that is reflected by the at least partially radar radiation transparent body 85 while at the same time the atmosphere inside the mold cavity 30 may be separated from the atmosphere surrounding the casting apparatus 10 as described with reference to FIG. 5. The at least partially radar transparent body 85 may for example be made of glass and/or may be integrally provided with the casing or removable lid 80.

Figure 7:
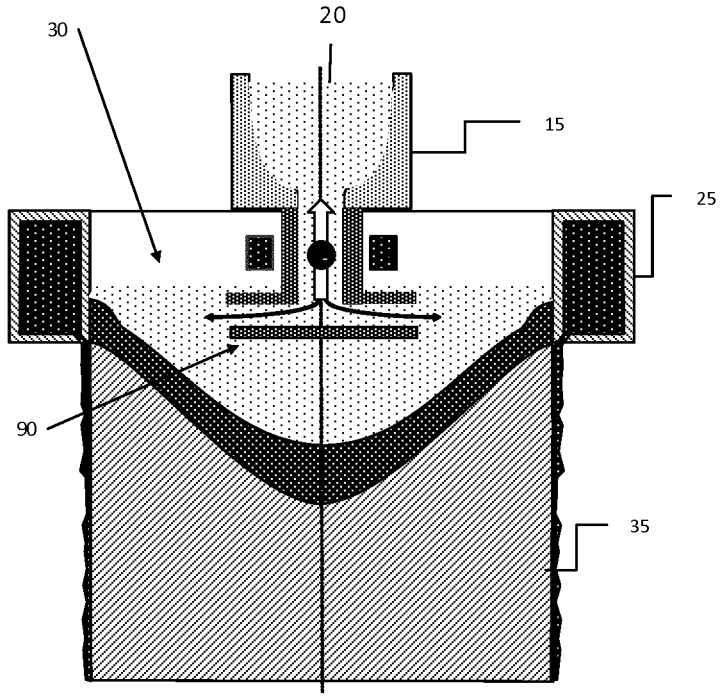
FIG. 7 shows a schematic view of a casting apparatus according to an embodiment of the invention comprising a flow diverter.

FIG. 7 shows a further embodiment of the invention. The casting apparatus 10 according to the invention may comprise a flow diverter 90 that is provided on the flow path 55 downstream of the pump 60 to direct at least a portion of the liquid metal 20 in a predetermined direction in the mold cavity 30. The two arrows in FIG. 7 schematically show how at least a part of the liquid metal 20 flowing into the mold cavity 30 is diverted by the flow diverter 90 to predetermined directions in the mold cavity 30. The flow diverter 90 may for example optimize the inflow of liquid metal 20 into the mold cavity 30 and the temperature distribution in the mold cavity 30, in particular when the mold 25 has a non-symmetric shape when seen along the vertical direction (that is a direction from the first side 26 towards the second side 27 of the mold 25). The flow diverter 90 may for example be provided if the mold 25 has a rectangular shape, T-bar shape or any other non-symmetric shape when seen in the vertical direction.

Figure 8:
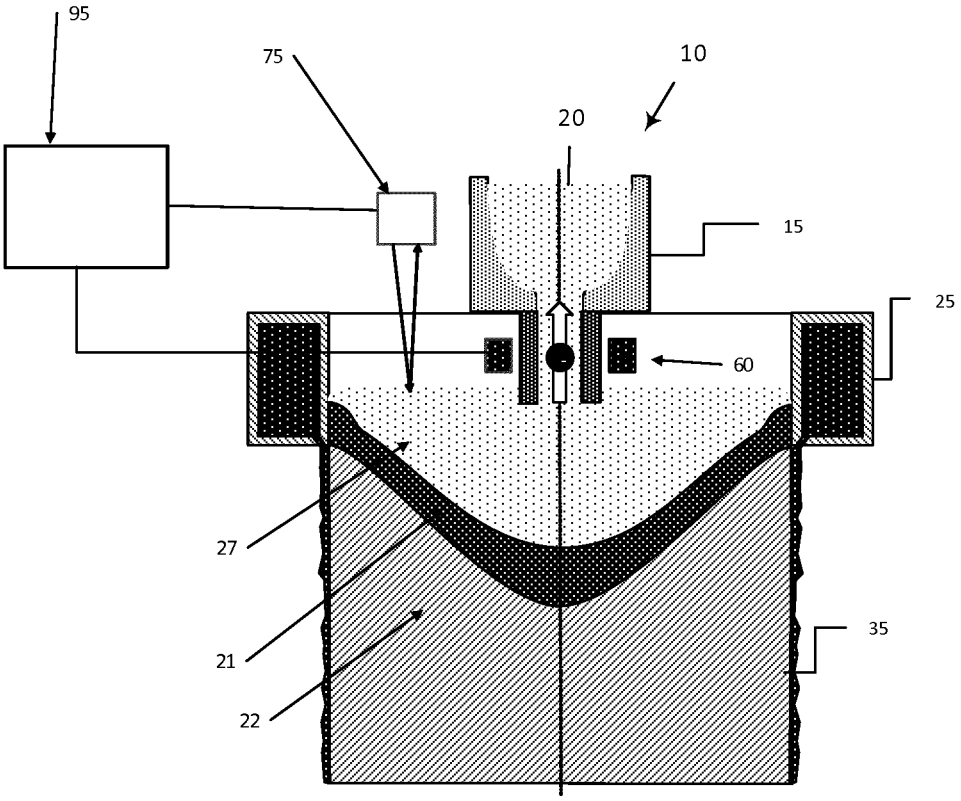
FIG. 8 shows a schematic view of a casting apparatus according to an embodiment of the invention comprising a controller.

With reference to FIG. 8, the casting apparatus 10 may comprise a controller 95. The controller 95 may for example be implemented as an electronic control unit. The controller 95 may be operably connected with the pump 60 to control a pump function of the pump 60. Optionally, if the casting apparatus 10 comprises a sensor 75, the controller 95 may in addition be operably connected with the sensor 75. The controller 95 may be configured to operate the pump 60 based on the level value h measured by the sensor 75 (actual value) and a predetermined set value indicative of a desired level h of the liquid metal 20 in the mold cavity 30, such that a difference between the actual value and the set value is minimized. That is, the controller 95 may be configured to control the level h of liquid metal 20 in the mold cavity 30 according to an intended value (the set value) by operating the pump 60 based on a signal from the sensor 75. The controller 95 may for example operate according to an PID control algorithm or any other algorithm that uses proportional (P) and/or integral (I) and/or derivative (D) (closed-loop) feedback control.

The controller 95 may be configured to change the predetermined set value from a value indicative of a higher level h of the liquid metal 20 in the mold cavity 30 earlier in the casting operation of the cast product 35 to a value indicative of a lower level h of the liquid metal 20 in the mold cavity 30 later in the casting operation of the cast product 35. That is, the set value may be changed, e.g. during an initialization phase of a casting operation of a cast product 35 before the casting operation reaches a steady state operation. It has been found that such a change of the predetermined set value may result in a better quality of the cast product, as a preset filling rate of the mold cavity during the initial phase of casting and a gradual reduction of the metal level as the casting speed is increased during the early phase of casting toward a steady-state situation where the casting parameters and the metal level is kept constant until the end of cast.

In light of the above, a method for continuous or semi-continuous casting of a cast product 35 according to the invention may comprise supplying liquid metal 20 from the reservoir 15 into the mold cavity 30 of the direct chill casting mold 25 along a flow path 55 defined between the reservoir 15 and the mold cavity 30 by using a gravitational force, and generating a force acting on the liquid metal 20 using the pump 60 that acts against the flow of the liquid metal 20 along the flow path 55 caused by the gravitational force to control supply of the liquid metal 20 to the mold cavity 30 to control a level h of liquid metal 20 in the mold cavity 30 during casting of the cast product 35.

The method may further comprise calculating a set value indicative of a desired level h of the liquid metal 20 in the mold cavity 30, measuring an actual value indicative of the actual level h of liquid metal 20 present in the mold cavity 30 using the sensor 75, and controlling generating the force using the pump 60, for example a direct current electromagnetic pump 60, such that a difference between the set value and the actual value is minimized. The generating the force using the pump 60 may comprise generating an electromagnetic field acting on the liquid metal 20 that results in a force having a direction opposing a flow of the liquid metal 20 along the flow path 55. The method described herein may be carried out using the casting apparatus 10 according to embodiments of the invention.

All embodiments described herein may be combined with each other unless specified otherwise. Features described with respect to the casting apparatus 10 also apply as corresponding method steps for the method described herein and vice versa.

The invention claimed is:

1. A casting apparatus (10) for continuous or semi-continuous casting of a cast product (35) comprising a reservoir (15) for supplying liquid metal (20), wherein the liquid metal (20) is liquid aluminium or aluminium alloy and the cast product (35) is an aluminium or aluminium alloy product, a direct chill casting mold (25) having a mold cavity (30) for at least temporarily holding liquid metal (20) and to at least partially solidify the liquid metal (20) into a cast product (35), wherein a flow path (55) for the liquid metal (20) is defined between the reservoir (15) and the mold cavity (30), and wherein the casting apparatus (10) is configured such that the liquid metal (20) has a tendency to flow along the flow path (55) from the reservoir (15) into the mold cavity (30) by gravity (g), wherein the liquid metal (20) enters the mold cavity (30) via a first vertically higher side (26) of the mold (25), and wherein the cast product (35) exits the mold (25) via a second vertically lower side (27) of the mold (25), and a pump (60) disposed on the flow path (55) between the reservoir (15) and the mold cavity (30), wherein the pump (60) is operable to generate a force in the liquid metal (20) that is acting against the tendency of the liquid metal (20) to flow along the flow path (55) from the reservoir (15) into the mold cavity (30) by gravity (g) to control a flow of the liquid metal (20) from the reservoir (15) into the mold cavity (30), wherein the pump (60) is a direct current electromagnetic pump, wherein a flow diverter (90) is provided on the flow path (55) downstream of the pump (60) to direct at least a portion of the liquid metal (20) in a predetermined direction in the mold cavity (30) such that the liquid metal (20) laminarly flows into the mold cavity (30), and wherein the predetermined direction is perpendicular to the flow path (55) between the reservoir (15) and the mold cavity (30).

2. The casting apparatus (10) according to claim 1, further comprising a sensor (75) for detecting a level (h) of liquid metal (20) in the mold cavity (30) and for outputting a level value indicative of the level (h) of liquid metal (20) in the mold cavity (30), and a controller (95), wherein the sensor (75) and the pump (60) are operably connected with the controller (95), and wherein the controller (95) is configured to operate the pump (60) based on the level value and a predetermined set value indicative of a desired level of the liquid metal (20) in the mold cavity (30) such that a difference between the level value and the set value is minimized.

3. The casting apparatus (10) according to claim 2, wherein the first side (26) of the mold (25) is at least partially sealed so that an atmosphere within the mold cavity (30) is separated from an atmosphere surrounding the casting apparatus (10), and wherein the atmosphere within the mold cavity (30) between the liquid metal (20) in the mold cavity (30) and the first side (26) is controlled such as to control oxidation of the liquid metal (20) in the mold cavity (30).

4. The casting apparatus (10) according to claim 2, wherein the sensor (75) is a radar sensor that emits electromagnetic radar radiation (76) having a frequency of 80 GHz or higher that is incident on the liquid metal (20) in the mold cavity (30) in a radar radiation area (85*c*).

5. The casting apparatus (10) according to claim 4, wherein there is provided an at least partially radar radiation transparent body (85) in a radar beam path between the radar sensor (75) and the liquid metal (20) in the mold cavity (30), and wherein the at least partially radar radiation transparent body (85) has two outer surfaces (85*a*, 85*b*) that each have a normal vector that is not parallel to a straight line between the radar sensor (75) and the liquid metal (20) in the mold cavity (30) in the radar radiation area (85*c*) to avoid detection of radar radiation (76) reflected by the at least partially radar radiation transparent body (85) with the radar sensor (75).

6. The casting apparatus (10) according to claim 5, wherein the at least partially radar radiation transparent body (85) is provided integrally with the sealed first side (26) of the mold.

7. The casting apparatus (10) according to claim 2, wherein the controller (95) is configured to change the predetermined set value during a casting operation of the cast product (35).

8. The casting apparatus (10) according to claim 7, wherein the controller (95) is configured to change the predetermined set value from a value indicative of a higher level of the liquid metal (20) in the mold cavity (30) earlier in the casting operation of the cast product (35) to a value indicative of a lower level of the liquid metal (20) in the mold cavity (30) later in the casting operation of the cast product (35).

9. The casting apparatus (10) according to claim 1, wherein the mold (25) comprises means (45, 50) for active cooling of the cast product (35).

10. A method for continuous or semi-continuous casting of a cast product (35) using a casting apparatus as described in claim 1, comprising providing the casting apparatus as described in claim 1, supplying liquid metal from a reservoir (15) into a mold cavity (30) of a direct chill casting mold (25) along a flow path (55) defined between the reservoir (15) and the mold cavity (30) by using a gravitational force, and generating a force acting on the liquid metal (20) using a pump (60) that acts against the flow of the liquid metal (20) along the flow path (55) caused by the gravitational force to control supply of the liquid metal (20) to the mold cavity (30) to control a level (h) of liquid metal (20) in the mold cavity (30) during casting of the cast product (35).

11. The method according to claim 10, further comprising calculating a set value indicative of a desired level (h) of the liquid metal (20) in the mold cavity (30), measuring an actual value indicative of the actual level (h) of liquid metal (20) in the mold cavity (30), and controlling generating the force using the pump (60) such that a difference between the set value and the actual value is minimized.

12. The method according to claim 10, wherein generating the force using a pump (60) comprises generating an electromagnetic field acting on the liquid metal (20) that results in a force having a direction opposing a flow of the liquid metal (20) along the flow path (55).

* * * * *